US009257752B2

(12) United States Patent
Alexopoulos et al.

(10) Patent No.: US 9,257,752 B2
(45) Date of Patent: Feb. 9, 2016

(54) TUNABLE PROJECTED ARTIFICIAL MAGNETIC MIRROR AND APPLICATIONS THEREOF

(75) Inventors: Nicolaos G. Alexopoulos, Irvine, CA (US); Alfred Grau Besoli, Barcelona (ES); Chryssoula Kyriazidou, Kifisia (GR)

(73) Assignee: BROADCOM CORPORATION, Irvine, CA (US)

( * ) Notice: Subject to any disclaimer, the term of this patent is extended or adjusted under 35 U.S.C. 154(b) by 594 days.

(21) Appl. No.: 13/600,049

(22) Filed: Aug. 30, 2012

(65) Prior Publication Data

US 2013/0201072 A1 Aug. 8, 2013

Related U.S. Application Data

(63) Continuation-in-part of application No. 13/037,051, filed on Feb. 28, 2011, which is a continuation of application No. 13/034,957, filed on Feb. 25, 2011.

(60) Provisional application No. 61/614,066, filed on Mar. 22, 2012, provisional application No. 61/322,873, filed on Apr. 11, 2010.

(51) Int. Cl.

| | |
|---|---|
| ***H01Q 19/10*** | (2006.01) |
| ***H01Q 15/00*** | (2006.01) |
| ***H01Q 1/22*** | (2006.01) |
| ***H01Q 15/14*** | (2006.01) |

(52) U.S. Cl.
CPC ..... *H01Q 19/10* (2013.01); *H01Q 1/2283* (2013.01); *H01Q 15/008* (2013.01); *H01Q 15/0066* (2013.01); *H01Q 15/14* (2013.01)

(58) Field of Classification Search
CPC ..... H01Q 19/10; H01Q 21/0093; H01Q 9/32
USPC ..... 343/834, 749, 750, 912
See application file for complete search history.

(56) References Cited

U.S. PATENT DOCUMENTS

| | | | | |
|---|---|---|---|---|
| 7,472,409 | B1 * | 12/2008 | Linton | 725/76 |
| 2003/0043077 | A1 * | 3/2003 | Alexopoulos et al. | 343/700 MS |
| 2003/0231142 | A1 * | 12/2003 | McKinzie et al. | 343/909 |
| 2004/0140945 | A1 * | 7/2004 | Werner et al. | 343/909 |
| 2004/0263420 | A1 * | 12/2004 | Werner et al. | 343/909 |
| 2009/0109112 | A1 * | 4/2009 | Pendry et al. | 343/787 |

* cited by examiner

*Primary Examiner* — Dameon E Levi
*Assistant Examiner* — Collin Dawkins
(74) *Attorney, Agent, or Firm* — Garlick & Markison; Randy W. Lacasse

(57) ABSTRACT

A tunable projected artificial magnetic minor (PAMM) includes a plurality of artificial magnetic minor (AMM) cells and a control module. The AMM cells collectively produce an artificial magnetic conductor (AMC) having a geometric shape a distance from a surface of the tunable PAMM for an electromagnetic signal in a given frequency range. The control module is operably coupled to the plurality of AMM cells and provides control information to one or more of the AMM cells to tune at least one of the geometric shape of the AMC and the distance of the AMC from the surface of the tunable PAMM.

20 Claims, 17 Drawing Sheets

TUNABLE PROJECTED ARTIFICIAL MAGNETIC MIRROR AND APPLICATIONS THEREOF

CROSS REFERENCE TO RELATED PATENTS

This patent application is claiming priority under 35 USC §119(e) to a provisionally filed patent application entitled PROGRAMMABLE SUBSTRATE AND PROJECTED ARTIFICIAL MAGNETIC CONDUCTOR, having a provisional filing date of Mar. 22, 2012, and a provisional Ser. No. 61/614,066 which is incorporated by reference herein.

This patent application is further claiming priority under 35 USC §120 as a continuation-in-part patent application of co-pending patent application entitled RF AND NFC PAMM ENHANCED ELECTROMAGNETIC SIGNALING, having a filing date of Feb. 28, 2011, and a Ser. No. of 13/037,051, which is incorporated herein by reference, and which claims priority under 35 USC §120 as a continuing patent application of co-pending patent application entitled, "PROJECTED ARTIFICIAL MAGNETIC MIRROR", having a filing date of Feb. 25, 2011, and a Ser. No. of 13/034,957 , which is incorporated herein by reference and which claims priority under 35 USC §119(e) to a provisionally filed patent application entitled, "PROJECTED ARTIFICIAL MAGNETIC MIRROR", having a provisional filing date of Apr. 11, 2010, and a provisional Ser. No. of 61/322,873, which is incorporated by reference herein.

STATEMENT REGARDING FEDERALLY SPONSORED RESEARCH OR DEVELOPMENT

NOT APPLICABLE

INCORPORATION-BY-REFERENCE OF MATERIAL SUBMITTED ON A COMPACT DISC

NOT APPLICABLE

BACKGROUND OF THE INVENTION

1. Technical Field of the Invention

This invention relates generally to electromagnetism and more particularly to electromagnetic circuitry.

2. Description of Related Art

Artificial magnetic conductors (AMC) are known to suppress surface wave currents over a set of frequencies at the surface of the AMC. As such, an AMC may be used as a ground plane for an antenna or as a frequency selective surface band gap.

An AMC may be implemented by metal squares of a given size and at a given spacing on a layer of a substrate. A ground plane is on another layer of the substrate. Each of the metal squares is coupled to the ground plane such that, a combination of the metal squares, the connections, the ground plane, and the substrate, produces a resistor-inductor-capacitor (RLC) circuit that produces the AMC on the same layer as the metal squares within the set of frequencies.

BRIEF DESCRIPTION OF THE SEVERAL VIEWS OF THE DRAWING(S)

DETAILED DESCRIPTION OF THE INVENTION

Figure 1:
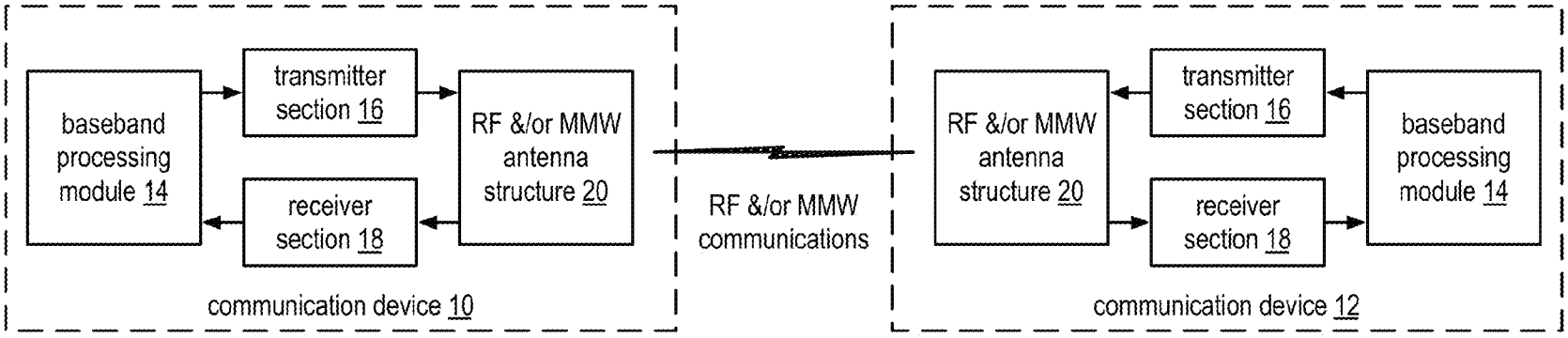
FIG. 1 is a schematic block diagram of an embodiment of communication devices in accordance with the present invention.

FIG. 1 is a schematic block diagram of an embodiment of communication devices 10, 12 communicating via radio frequency (RF) and/or millimeter wave (MMW) communication mediums. Each of the communication devices 10 12 includes a baseband processing module 14, a transmitter section 16, a receiver section 18, and an RF &/or MMW antenna structure 20. The RF &/or MMW antenna structure 20 will be described in greater detail with reference to one or more of FIGS. 2-23. Note that a communication device 10, 12 may be a cellular telephone, a wireless local area network (WLAN) client, a WLAN access point, a computer, a video game console and/or player unit, etc.

In an example of operation, one of the communication devices 10 12 has data (e.g., voice, text, audio, video, graphics, etc.) to transmit to the other communication device. In this instance, the baseband processing module 14 receives the data (e.g., outbound data) and converts it into one or more outbound symbol streams in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion includes one or more of: scrambling, puncturing, encoding, interleaving, constellation mapping, modulation, frequency spreading, frequency hopping, beamforming, space-time-block encoding, space-frequency-block encoding, frequency to time domain conversion, and/or digital baseband to intermediate frequency conversion. Note that the baseband processing module converts the outbound data into a single outbound symbol stream for Single Input Single Output (SISO) communications and/or for Multiple Input Single Output (MISO) communications and converts the outbound data into multiple outbound symbol streams for Single Input Multiple Output (SIMO) and Multiple Input Multiple Output (MIMO) communications.

The transmitter section 16 converts the one or more outbound symbol streams into one or more outbound RF signals that has a carrier frequency within a given frequency band (e.g., 2.4 GHz, 5 GHz, 57-66 GHz, etc.). In an embodiment, this may be done by mixing the one or more outbound symbol streams with a local oscillation to produce one or more up-converted signals. One or more power amplifiers and/or power amplifier drivers amplifies the one or more up-converted signals, which may be RF bandpass filtered, to produce the one or more outbound RF signals. In another embodiment, the transmitter section 16 includes an oscillator that produces an oscillation. The outbound symbol stream(s) provides phase information (e.g., +/−Δθ [phase shift] and/or θ(t) [phase modulation]) that adjusts the phase of the oscillation to produce a phase adjusted RF signal(s), which is transmitted as the outbound RF signal(s). In another embodiment, the outbound symbol stream(s) includes amplitude information (e.g., A(t) [amplitude modulation]), which is used to adjust the amplitude of the phase adjusted RF signal(s) to produce the outbound RF signal(s).

In yet another embodiment, the transmitter section 14 includes an oscillator that produces an oscillation(s). The outbound symbol stream(s) provides frequency information (e.g., +/−Δf [frequency shift] and/or f(t) [frequency modulation]) that adjusts the frequency of the oscillation to produce a frequency adjusted RF signal(s), which is transmitted as the outbound RF signal(s). In another embodiment, the outbound symbol stream(s) includes amplitude information, which is used to adjust the amplitude of the frequency adjusted RF signal(s) to produce the outbound RF signal(s). In a further embodiment, the transmitter section includes an oscillator that produces an oscillation(s). The outbound symbol stream(s) provides amplitude information (e.g., +/−ΔA [amplitude shift] and/or A(t) [amplitude modulation) that adjusts the amplitude of the oscillation(s) to produce the outbound RF signal(s).

The RF &/or MMW antenna structure 20 receives the one or more outbound RF signals and transmits it. The RF &/or MMW antenna structure 20 of the other communication devices receives the one or more RF signals and provides it to the receiver section 18.

The receiver section 18 amplifies the one or more inbound RF signals to produce one or more amplified inbound RF signals. The receiver section 18 may then mix in-phase (I) and quadrature (Q) components of the amplified inbound RF signal(s) with in-phase and quadrature components of a local oscillation(s) to produce one or more sets of a mixed I signal and a mixed Q signal. Each of the mixed I and Q signals are combined to produce one or more inbound symbol streams. In this embodiment, each of the one or more inbound symbol streams may include phase information (e.g., +/−Δθ [phase shift] and/or θ(t) [phase modulation]) and/or frequency information (e.g., +/−Δf [frequency shift] and/or f(t) [frequency modulation]). In another embodiment and/or in furtherance of the preceding embodiment, the inbound RF signal(s) includes amplitude information (e.g., +/−ΔA [amplitude shift] and/or A(t) [amplitude modulation]). To recover the amplitude information, the receiver section includes an amplitude detector such as an envelope detector, a low pass filter, etc.

The baseband processing module 14 converts the one or more inbound symbol streams into inbound data (e.g., voice, text, audio, video, graphics, etc.) in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion may include one or more of: digital intermediate frequency to baseband conversion, time to frequency domain conversion, space-time-block decoding, space-frequency-block decoding, demodulation, frequency spread decoding, frequency hopping decoding, beamforming decoding, constellation demapping, deinterleaving, decoding, depuncturing, and/or descrambling. Note that the baseband processing module converts a single inbound symbol stream into the inbound data for Single Input Single Output (SISO) communications and/or for Multiple Input Single Output (MISO) communications and converts the multiple inbound symbol streams into the inbound data for Single Input Multiple Output (SIMO) and Multiple Input Multiple Output (MIMO) communications.

Figure 2:
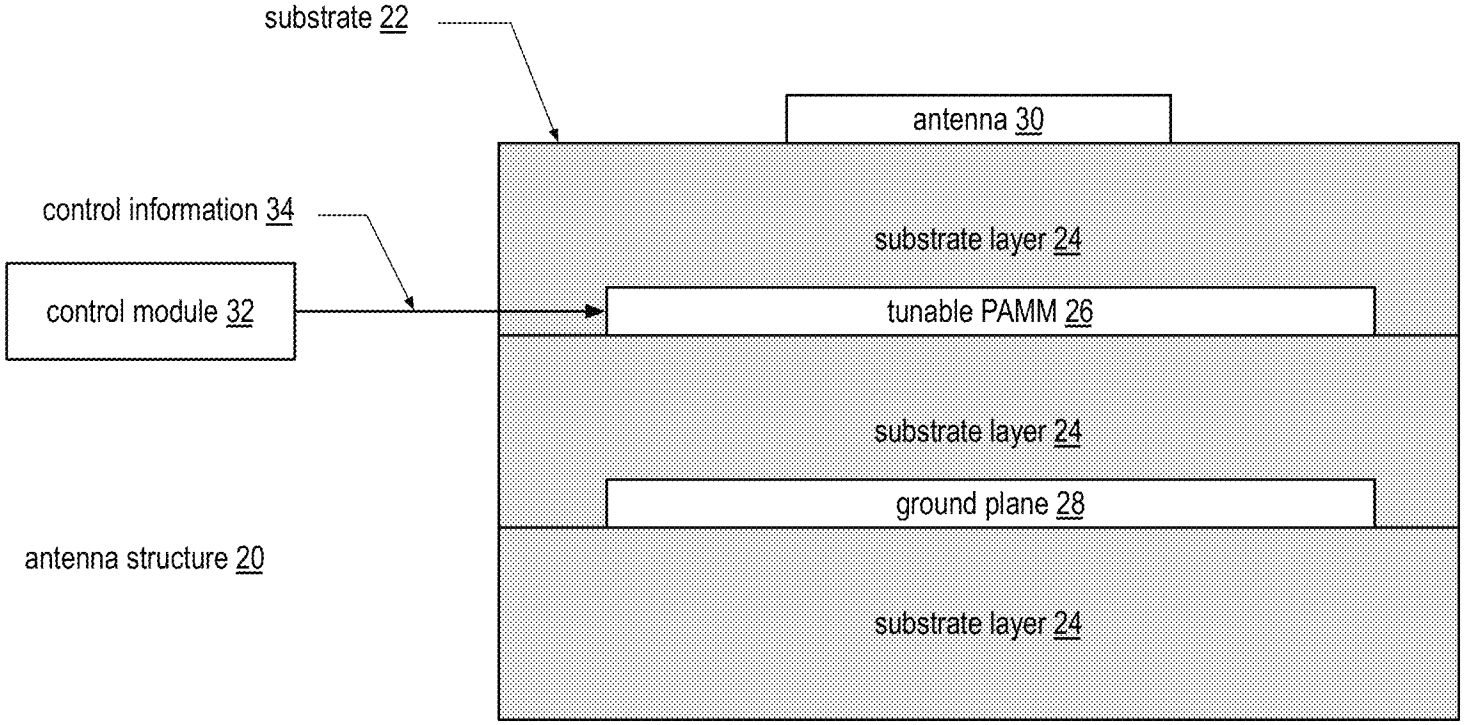
FIG. 2 is a schematic block diagram of an embodiment of an antenna structure in accordance with the present invention.

FIG. 2 is a schematic block diagram of an embodiment of an antenna structure 20 that may be implemented on a substrate. The substrate may be a die of an integrated circuit (IC), an IC package substrate, a printed circuit board (PCB), or other structure that includes a plurality of dielectric layers, metal traces, circuits, etc. that can be implemented on one or more metal layers supported by the dielectric layers. The antenna structure 20 includes an antenna 30 (e.g., a monopole, a dipole, etc.) on one layer 24 of the substrate 22, a tunable projected artificial magnetic mirror (PAMM) 26 on another layer 24, a ground plane 28 on another layer 24, and a control module 32. The tunable PAMM 26 includes a plurality of artificial magnetic minor (AMM) cells (not shown).

In an example of operation, the control module 32 generates control information 34 and provides it to one or more of the AMM cells of the PAMM 26. The control information 34 includes one or more control signals for tuning an electromagnetic property, or properties, (e.g., radiation pattern, polarization, gain, scatter signal phase, scatter signal magnitude, gain, etc.) of one or more of the AMM cells within a given frequency band for an electromagnetic signal. For example, the electromagnetic signal may be a radar signal in a 2 GHz frequency band, in a 60 GHz frequency band, etc. As another example, the electromagnetic signal may be a communication signal in a 900 MHz frequency band, a 1.8 MHz frequency band, a 2 GHz frequency band, a 2.4 GHz frequency band, 5 GHz frequency band, a 29 GHz frequency band, a 60 GHz frequency band, or some other frequency band.

The tuning of one or more of the AMM cells tunes a geometric shape of an artificial magnetic conductor (AMC) and/or distance of the AMC from the surface of the tunable PAMM for the electromagnetic signal. In general, the AMM cells collectively produce the AMC. By tuning electromagnetic properties of one or more of the AMM cells, the geometric shape, orientation, and/or distance of the AMC may be adjusted. For example, the geometric shape of the AMC may be one of a sphere, a partial sphere, a cylinder, a partial cylinder, a plane, a textured surface, a concaved surface, or a convex surface.

The control module 32 may determine the control information 34 in a variety of ways. For example, the control module 32 tests various electromagnetic property configurations of the AMM cells for a given signal to determine which configuration(s) provide a desired antenna response (e.g., gain, radiation pattern, polarization, etc.). As another example, the control module 32 determines the type of signal to be transmitted or received and, using a look up table, determines the control information. As yet another example, the control module 32 functions in a dynamic manner to generate the control information to adjust the AMC to adapt to changing conditions of the electromagnetic signal, the environment, etc.

Figure 3:
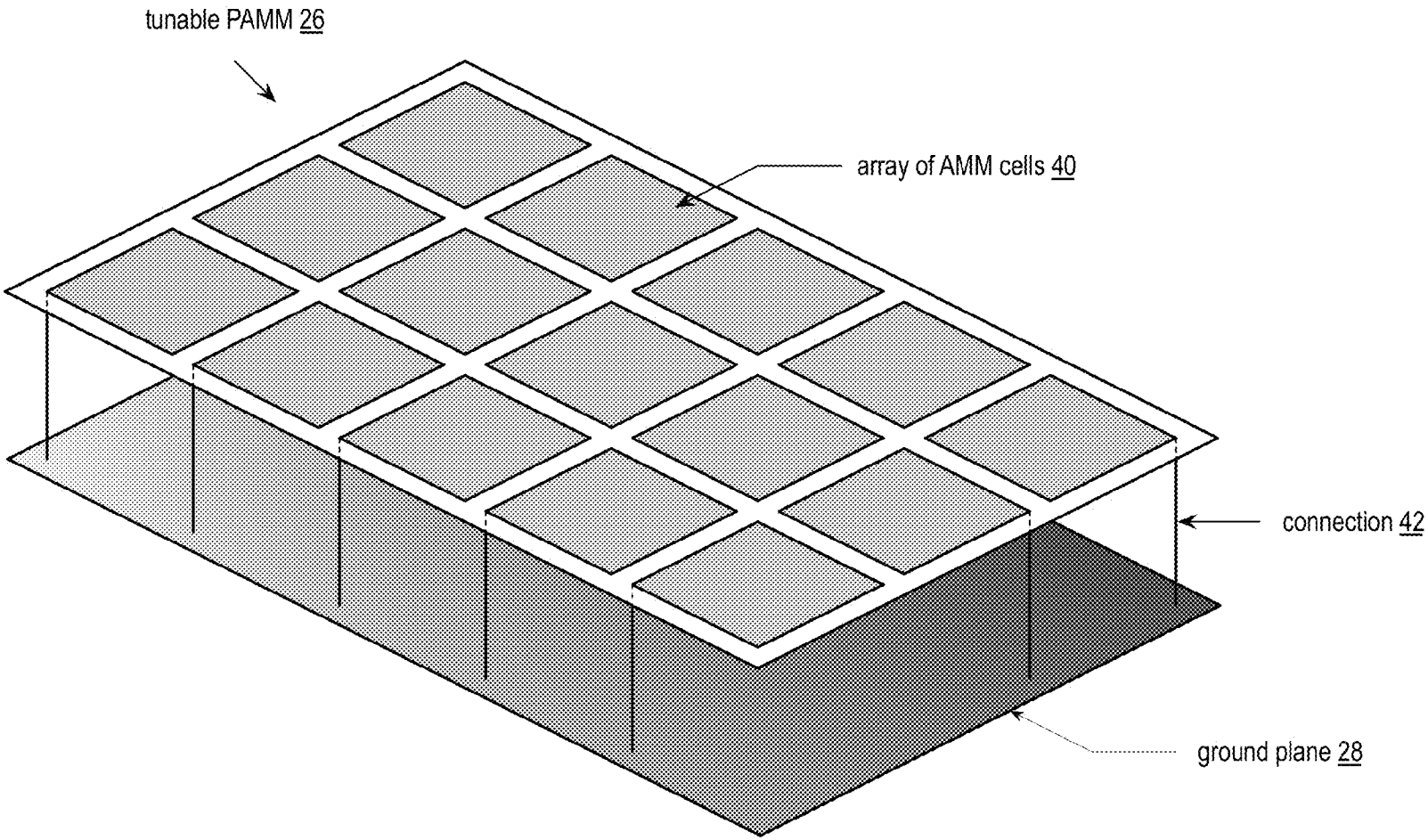
FIG. 3 is a diagram of an embodiment of a tunable projected artificial magnetic minor (PAMM) in accordance with the present invention.

FIG. 3 is a diagram of an embodiment of a tunable projected artificial magnetic minor (PAMM) 26 that includes a plurality, or array, of artificial magnetic minor (AMM) cells 40. In one embodiment, each of the AMM cells 40 includes a conductive element (e.g., a metal trace on layer of the substrate) that is substantially of the same shape, substantially of the same pattern, and substantially of the same size as in the other cells. The shape may be circular, square, rectangular, hexagon, octagon, elliptical, etc. and the pattern may be a spiral coil, a pattern with interconnecting branches, an $n^{th}$ order Peano curve, an $n^{th}$ order Hilbert curve, etc. In another embodiment, the conductive elements may be of different shapes, sizes, and/or patterns.

Within an AMM cell, the conductive element may be coupled to the ground plane 28 by one or more connectors (e.g., vias). Alternatively, the conductive element of an AMM cell may be capacitively coupled to the metal backing (e.g., no vias). While not shown in this figure, a conductive element of an AMM cell is coupled to an impedance element of the AMM cell, which will be further discussed with reference to one or more subsequent figures.

The plurality of conductive elements of the AMM cells is arranged in an array (e.g., 3×5 as shown). The array may be of a different size and shape. For example, the array may be a square of n-by-n conductive elements, where n is 2 or more. As another example, the array may be a series of concentric rings of increasing size and number of conductive elements. As yet another example, the array may be of a triangular shape, hexagonal shape, octagonal shape, etc.

Figure 4:
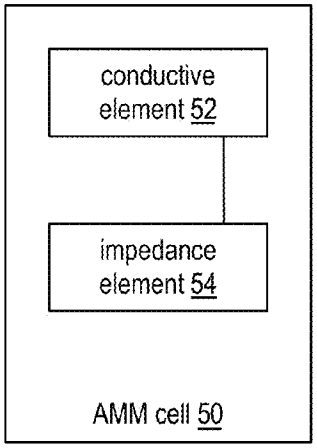
FIG. 4 is a schematic block diagram of an embodiment of an artificial magnetic minor (AMM) cell in accordance with the present invention.

FIG. 4 is a schematic block diagram of an embodiment of an artificial magnetic minor (AMM) cell 50 of the plurality of AMM cells 40. The AMM cell 50 includes a conductive element 52 and an impedance element 54, which may be fixed or variable. The conductive element is constructed of an electrically conductive material (e.g., a metal such as copper, gold, aluminum, etc.) and is of a shape (e.g., a spiral coil, a pattern with interconnecting branches, an $n^{th}$ order Peano curve, an $n^{th}$ order Hilbert curve, etc.) to form a lumped resistor-inductor-capacitor (RLC) circuit.

The impedance element 54 is coupled to the conductive element 52. An impedance of the impedance element 54 and an impedance of the RLC circuit establish an electromagnetic property (e.g., radiation pattern, polarization, gain, scatter signal phase, scatter signal magnitude, gain, etc.) for the AMM cell within the given frequency range, which contributes to the size, shape, orientation, and/or distance of the AMC.

Figure 5:
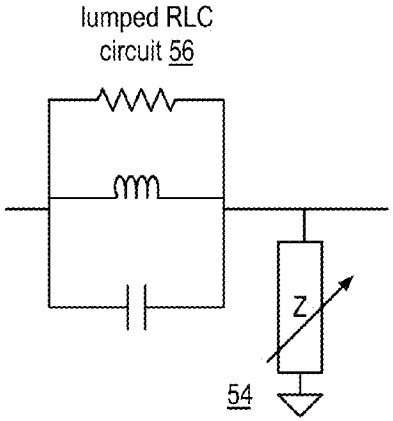
FIG. 5 is a circuit schematic block diagram of an embodiment of an artificial magnetic mirror (AMM) cell in accordance with the present invention.

FIG. 5 is a circuit schematic block diagram of an embodiment of an artificial magnetic minor (AMM) cell where the conductive element 52 is represented as a lumped RLC circuit 56. In this example, the impedance element 54 is a variable impedance circuit that is coupled in series with the RLC circuit 56. Note that in an alternate embodiment, the impedance element 54 may be a fixed impedance circuit.

Figure 6:
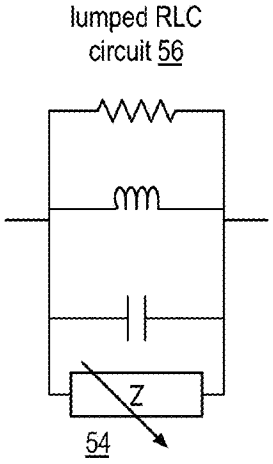
FIG. 6 is a circuit schematic block diagram of another embodiment of an artificial magnetic minor (AMM) cell in accordance with the present invention.

FIG. 6 is a circuit schematic block diagram of an embodiment of an artificial magnetic minor (AMM) cell where the conductive element 52 is represented as a lumped RLC circuit 56. In this example, the impedance element 54 is a variable impedance circuit that is coupled in parallel with the RLC circuit 56. Note that in an alternate, the impedance element 54 may be a fixed impedance circuit.

Figure 7:
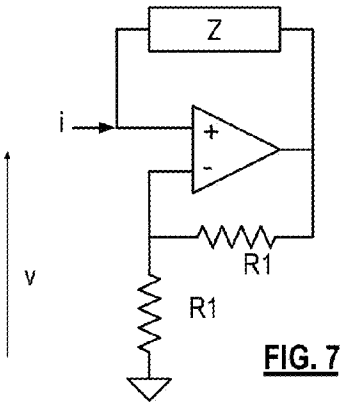
FIG. 7 is a circuit schematic block diagram of an embodiment of an impedance element of an AMM cell in accordance with the present invention.

FIG. 7 is a circuit schematic block diagram of an embodiment of a variable impedance element 54 of an AMM cell implemented as a negative resistor. The negative resistor includes an operational amplifier, a pair of resistors, and a passive component impedance circuit (Z), which may include a resistor, a capacitor, and/or an inductor.

Figure 8:
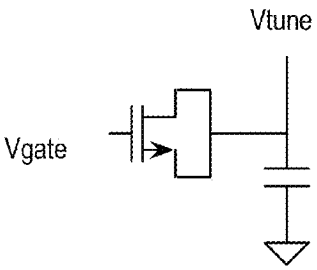
FIG. 8 is a circuit schematic block diagram of another embodiment of an impedance element of an AMM cell in accordance with the present invention.

FIG. 8 is a circuit schematic block diagram of another embodiment of a variable impedance element 54 of an AMM cell as a varactor. The varactor includes a transistor and a capacitor. The gate of the transistor is driven by a gate voltage (Vgate) and the connection of the transistor and capacitor is driven by a tuning voltage (Vtune). As an alternative embodiment of the variable impedance element 54, it may be implemented using passive components (e.g., resistors, capacitors, and/or inductors), where at least one of the passive components is adjustable.

Figure 9:
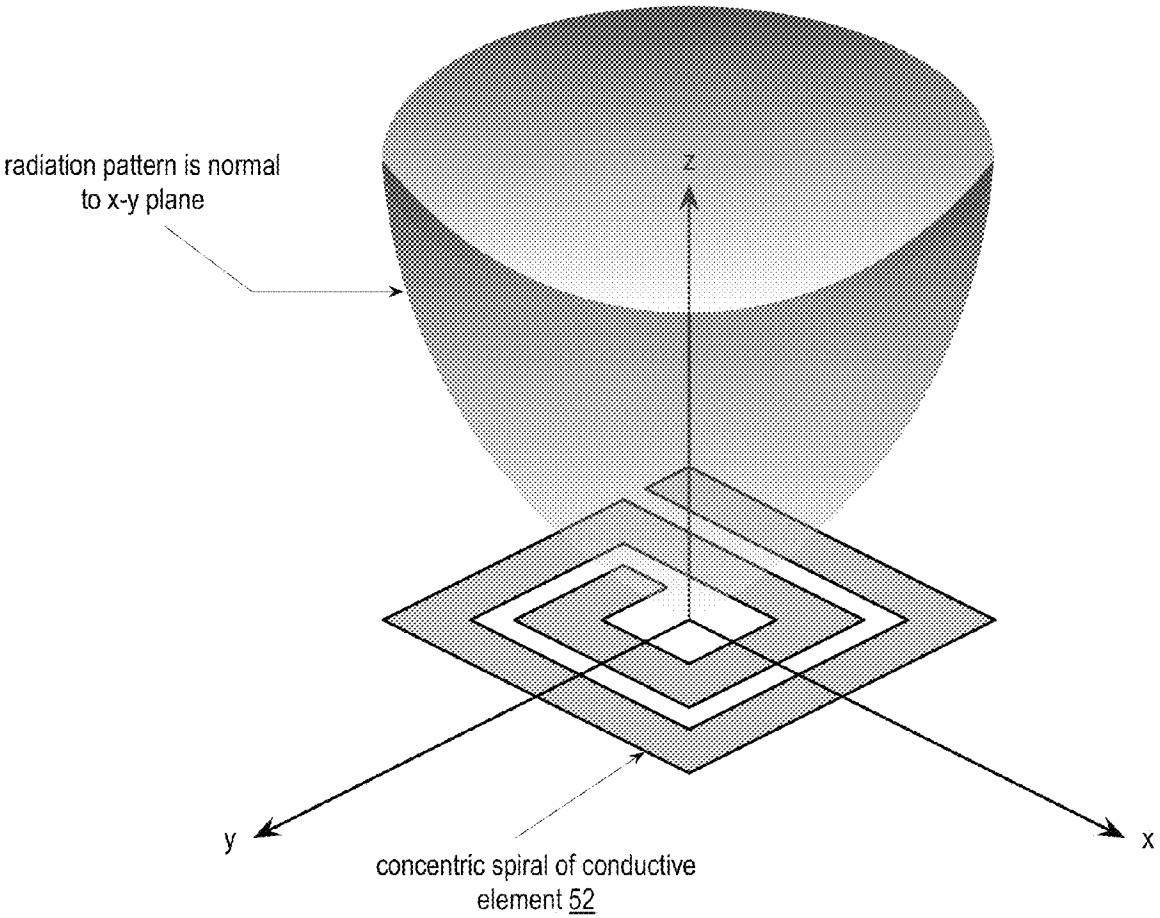
FIG. 9 is a diagram of an example radiation pattern of an AMM cell having a concentric spiral coil in accordance with the present invention.

FIG. 9 is a diagram of an example radiation pattern of an AMM cell having a conductive element in the shape of concentric spiral coil (e.g., symmetrical about a center point). In the presence of an external electromagnetic field (e.g., a transmitted RF and/or MMW signal, reflected radar signal), the coil functions as an antenna with a radiation pattern that is normal to its x-y plane. As such, when a concentric coil is incorporated into a projected artificial magnetic minor (PAMM), it reflects electromagnetic energy in accordance with its radiation pattern. For example, when an electromagnetic signal is received at an angle of incidence, the concentric coil, as part of the PAMM, will reflect the signal at the corresponding angle of reflection (i.e., the angle of reflection equals the angle of incidence).

Figure 10:
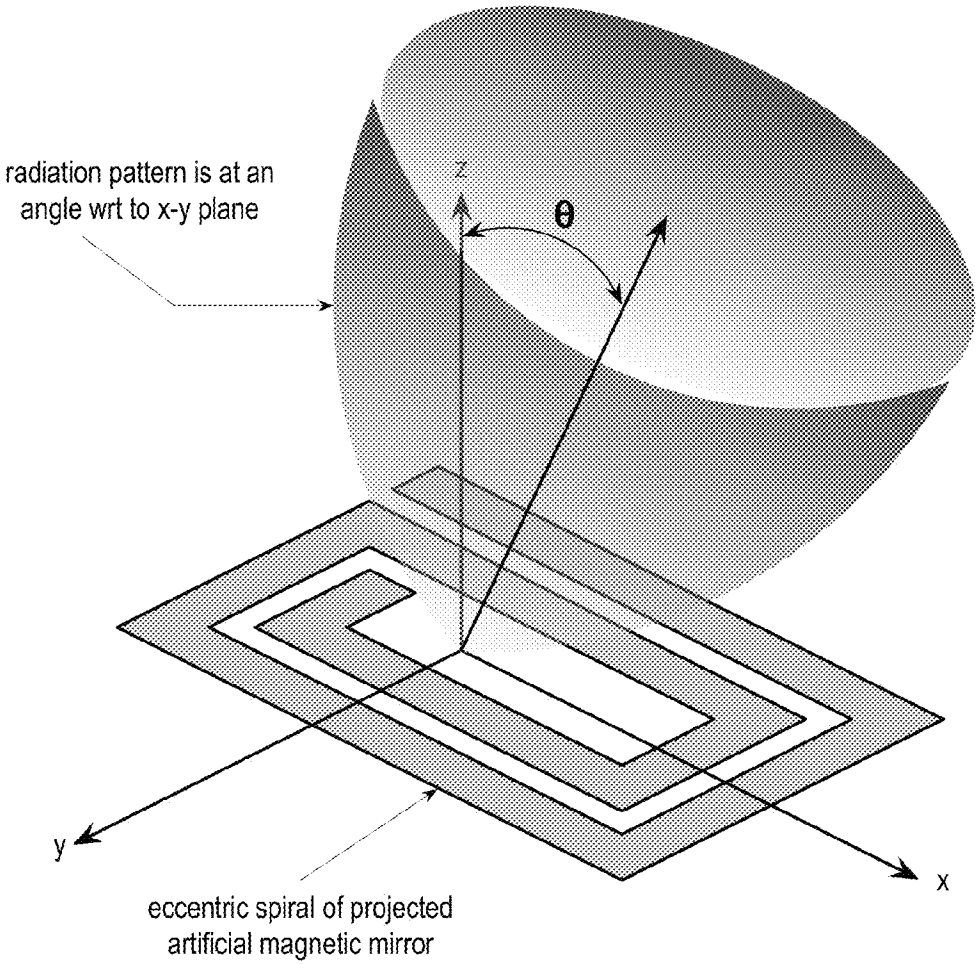
FIG. 10 is a diagram of an example radiation pattern of an AMM cell having a eccentric spiral coil in accordance with the present invention.

FIG. 10 is a diagram of an example radiation pattern of an AMM cell having a conductive element having an eccentric spiral coil (e.g., asymmetrical about a center point). In the presence of an external electromagnetic field (e.g., a transmitted RF and/or MMW signal, or reflected radar signal), the eccentric spiral coil functions as an antenna with a radiation pattern that is offset from normal to its x-y plane. The angle of offset (e.g., θ) is based on the amount of asymmetry of the spiral coil. In general, the greater the asymmetry of the spiral coil, the greater its angle of offset will be.

When an eccentric spiral coil is incorporated into a projected artificial magnetic minor (PAMM), it reflects electromagnetic energy in accordance with its radiation pattern. For example, when an electromagnetic signal is received at an angle of incidence, the eccentric spiral coil, as part of the PAMM, will reflect the signal at the corresponding angle of reflection plus the angle of offset (i.e., the angle of reflection equals the angle of incidence plus the angle of offset, which will asymptote parallel to the x-y plane). The properties of the coils (concentric and/or eccentric) in a PAMM can be further adjusted by adjusting the impedance of the impedance element attached thereto within an AMM cell of the PAMM.

Figure 11:
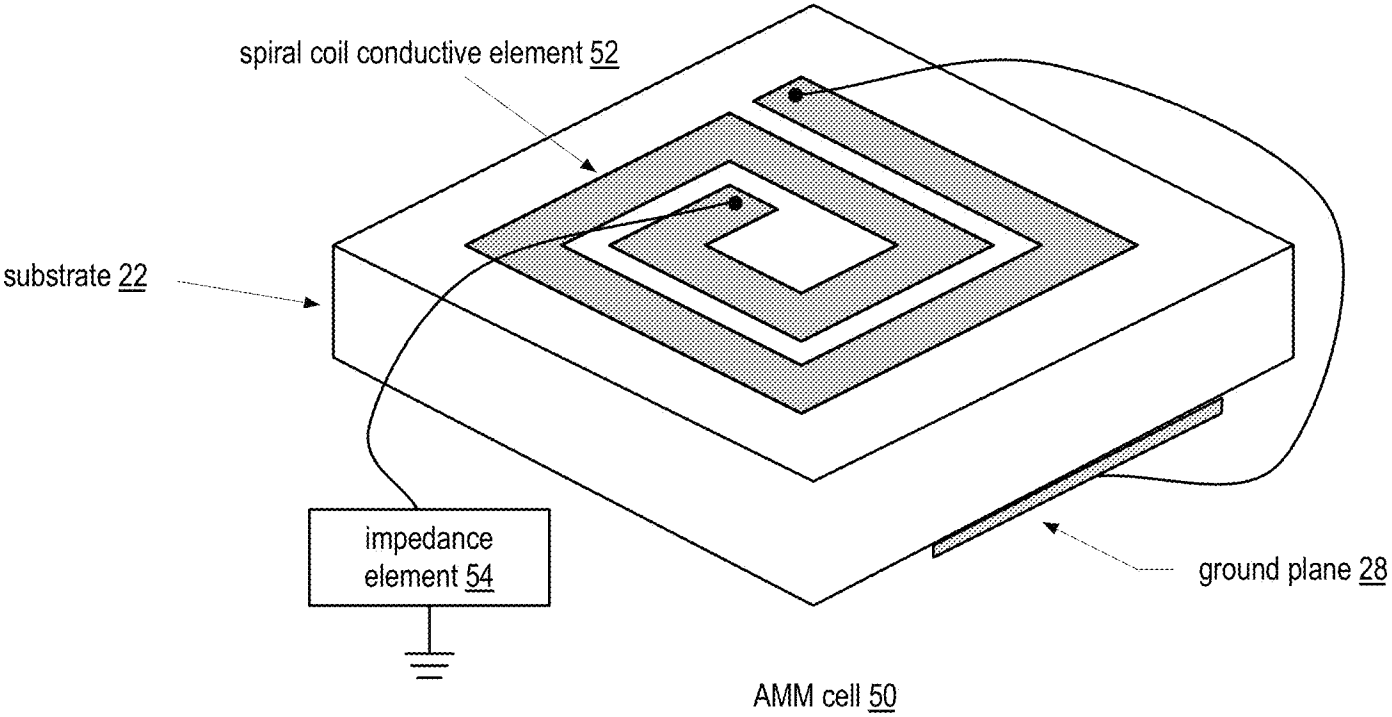
FIG. 11 is a circuit schematic block diagram of an embodiment of an AMM cell having a spiral coil in accordance with the present invention.

FIG. 11 is a circuit schematic block diagram of an embodiment of an AMM cell 50 that includes a spiral coil conductive element 52 (e.g., concentric or eccentric) on a surface of a substrate 22, an impedance element 54, and a ground plane 28. The impedance element 54 may be implemented on the same substrate layer as the conductive element, on the same layer as the ground plane 28 within an opening of the ground plane, or on a different layer of the substrate.

As shown, a first end of the spiral coil conductive element 52 is coupled to the ground plane 28 and a second end of the spiral coil conductive element 52 is coupled the impedance element 54. The coupling between the spiral coil conductive element 52, the ground plane 28, and the impedance element 54 may be one or more metal traces, vias, wires, etc.

Figure 12:
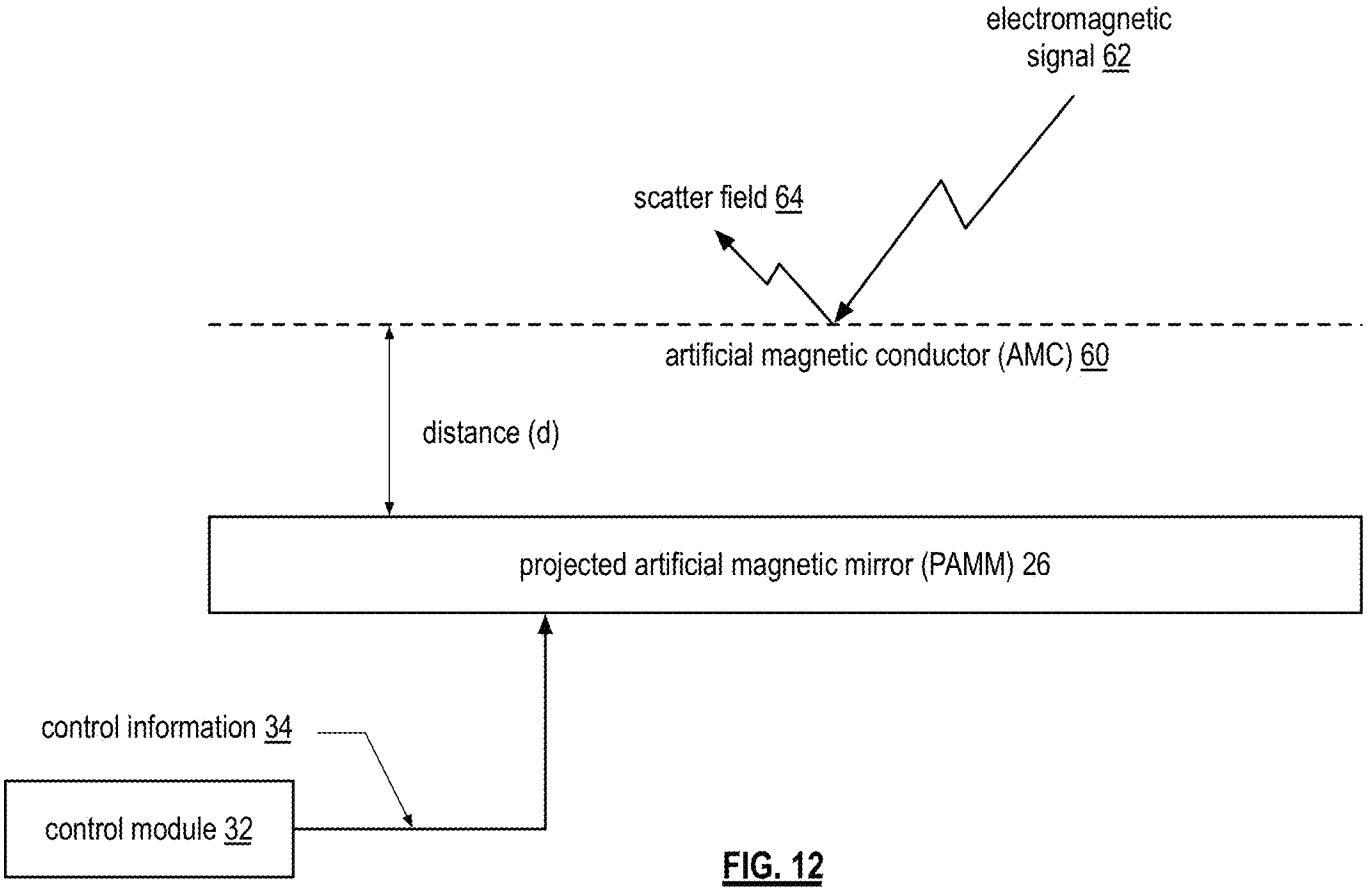
FIG. 12 is a diagram of an example a projected artificial magnetic conductor (AMC) in accordance with the present invention.

FIG. 12 is a diagram of an example of a projected artificial magnetic mirror (PAMM) 26 generating a projected artificial magnetic conductor (AMC) 60 a distance (d) above its surface. The shape of the projected AMC 60 is based on the characteristics of the artificial magnetic minor (AMM) cells of the PAMM 26, wherein the characteristics are adjustable via the control information 34. In this example, the projected AMC 60 is a plane. Alternatively, the shape of the AMC could be a sphere, a partial sphere, a cylinder, a partial cylinder, a plane, a textured surface, a concaved surface, or a convex surface. Note that the AMC 60 is a surface with an electromagnetic state in which the tangential magnetic field is zero. Further note that the AMC surface has a frequency band over which surface waves and current cannot propagate, making the AMC a minor of signals within the frequency band.

In this example, an electromagnetic signal 62 is reflected off of the AMC 60 producing a scatter field 64. If the electromagnetic properties of the AMM cells of the PAMM 26 are changed, the scatter field 64 is changed. The resulting change in the scatter field 64 corresponds to effectively changing the shape of the AMC 60.

Figure 13:
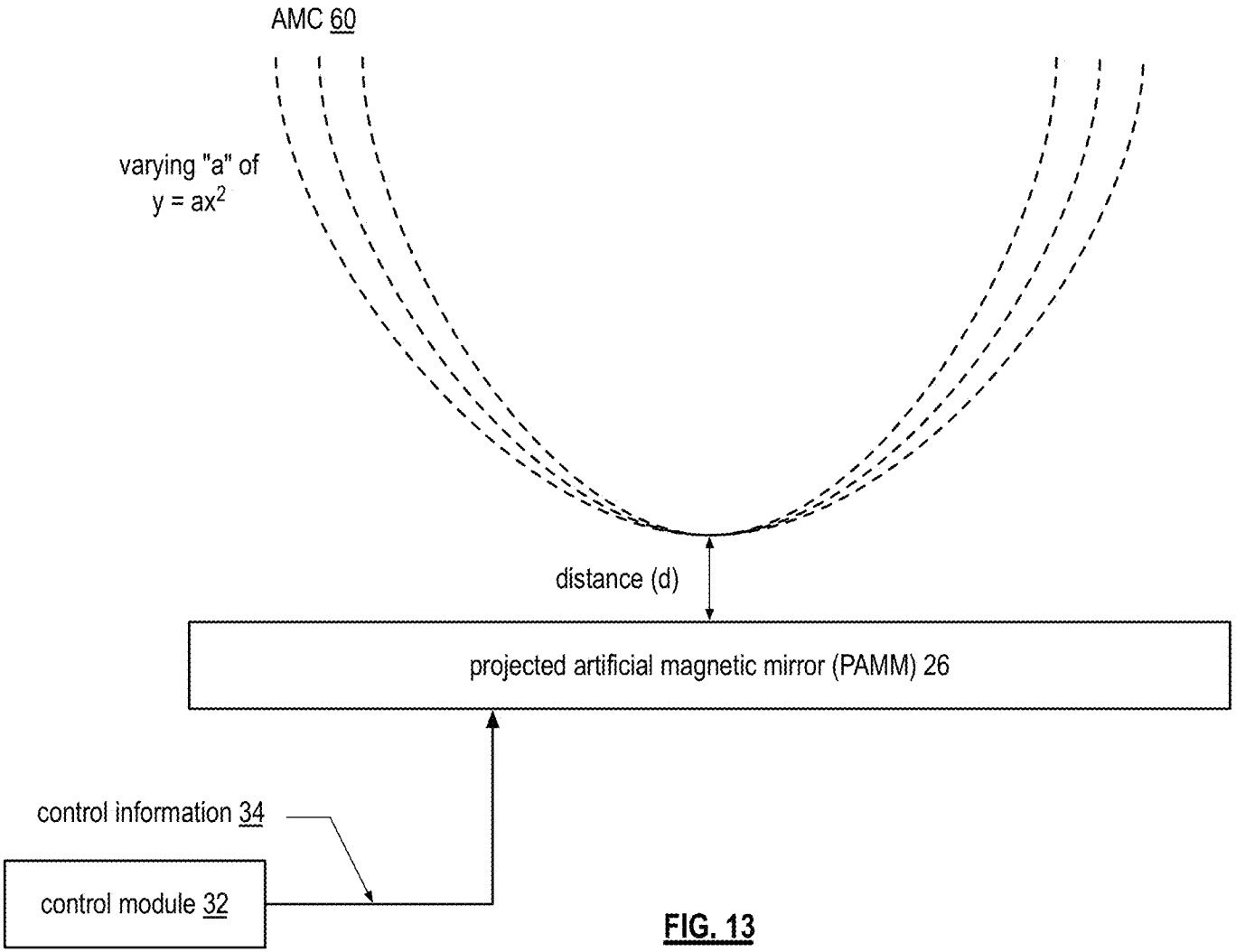
FIG. 13 is a diagram of another example a projected artificial magnetic conductor (AMC) in accordance with the present invention.

FIG. 13 is a diagram of another example of a projected artificial magnetic minor (PAMM) 26 generating a projected artificial magnetic conductor (AMC) 60 a distance (d) above its surface. The shape of the projected AMC 60 is based on the characteristics of the artificial magnetic mirror (AMM) cells of the PAMM 26, wherein the characteristics are adjustable via the control information 34. In this example, the projected AMC 60 is a parabolic shape of $y=ax^2$. The control module 32 generates the control information 34 to tune the "a" term of the parabolic shape, thereby changing the parabolic shape of the AMC 60.

Figure 14:
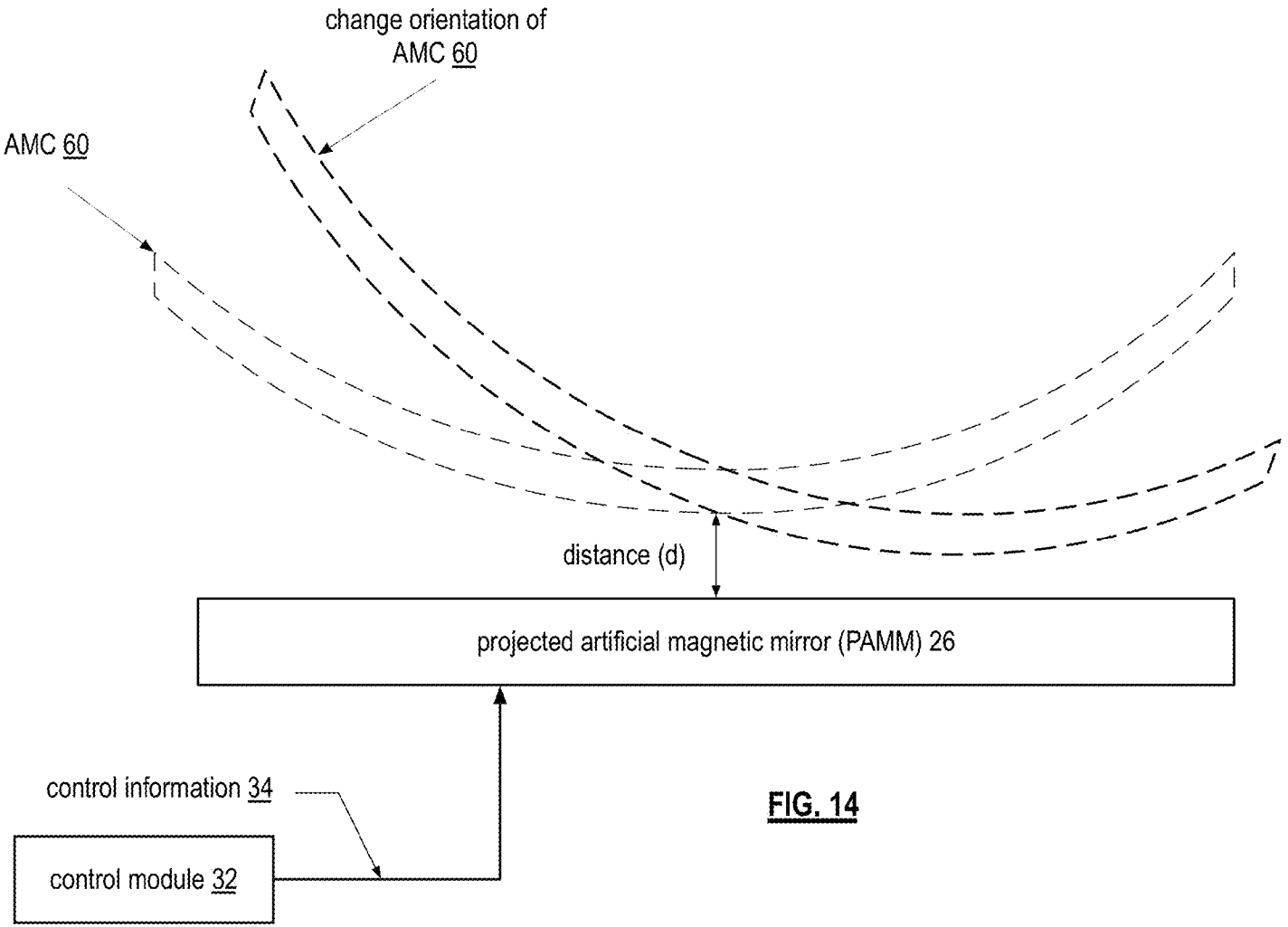
FIG. 14 is a diagram of an example of adjusting orientation of a projected artificial magnetic conductor (AMC) in accordance with the present invention.

FIG. 14 is a diagram of an example of a projected artificial magnetic mirror (PAMM) 26 generating an initial projected artificial magnetic conductor (AMC) 60 a distance (d) above its surface. The shape of the initial projected AMC 60 is parabolic shape. The control module 32 may adjust the orientation of the initial projected AMC 60 by adjusting the characteristics of the artificial magnetic mirror (AMM) cells of the PAMM 26. For example, the initial projected AMC 60 may be achieved by tuning the AMC cells to have a radiation pattern as shown in FIG. 9 and the orientation of the projected AMC 60 may be changed by tuning at least some of the AMC cells to have a radiation pattern as shown in FIG. 10.

Figure 15:
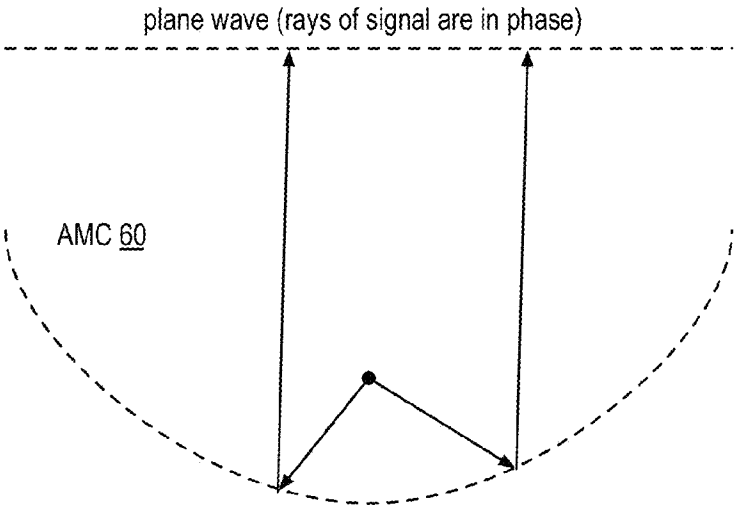
FIG. 15 is a diagram of an example of a plane wave resulting from a parabolic shaped projected artificial magnetic conductor (AMC) in accordance with the present invention.

FIG. 15 is a diagram of an example of a projected artificial magnetic mirror (PAMM) 26 generating a projected artificial magnetic conductor (AMC) 60 having a parabolic shape. For a given electromagnetic signal, the parabolic AMC 60 causes a plane wave to occur at some distance from the focal point of the parabolic AMC 60. Note that a plane wave is a plane in which the rays (e.g., scatter field) of the electromagnetic signal are in phase. Further note that the control module 32 may generate the control information 34 to tune the plurality of AMM cell such that a plane wave is formed with respect to the dish shaped AMC at a desired position with respect to the dish shaped AMC.

Figure 16:
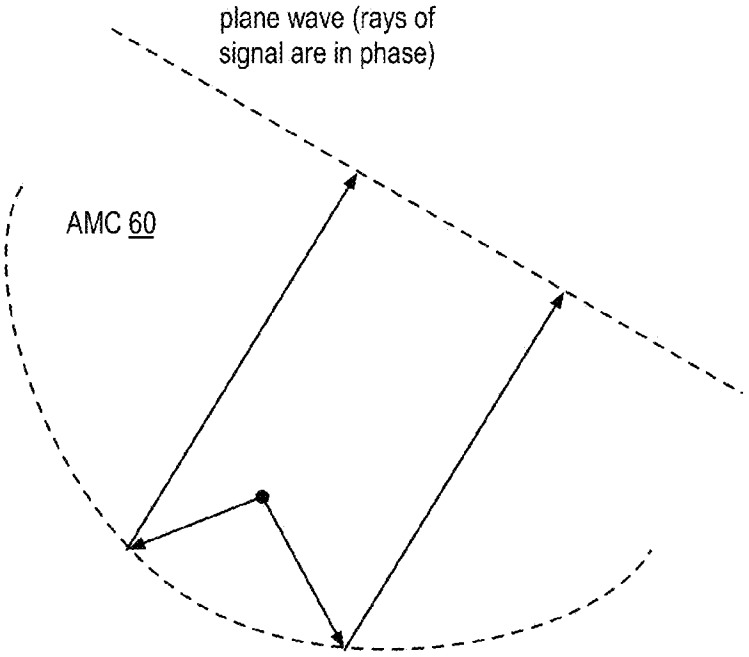
FIG. 16 is a diagram of another example of a plane wave resulting from a parabolic shaped projected artificial magnetic conductor (AMC) in accordance with the present invention.

FIG. 16 is a diagram of another example of a projected artificial magnetic minor (PAMM) 26 generating a projected artificial magnetic conductor (AMC) 60 having a parabolic shape at a shifted orientation than that of FIG. 15. For a given electromagnetic signal, the parabolic AMC 60 causes a plane wave to occur at some distance from the focal point of the parabolic AMC 60 and at an angle from the plane wave of FIG. 15. Note that the control module 32 may generate the control information 34 to tune the plurality of AMM cell such that orientation of the plane wave with respect to the dish shape is changed to effectuate signal scanning. For example, the dish shaped AMC may be effectively rotated to emulate rotation a dish antenna for a radar system.

Figure 17:
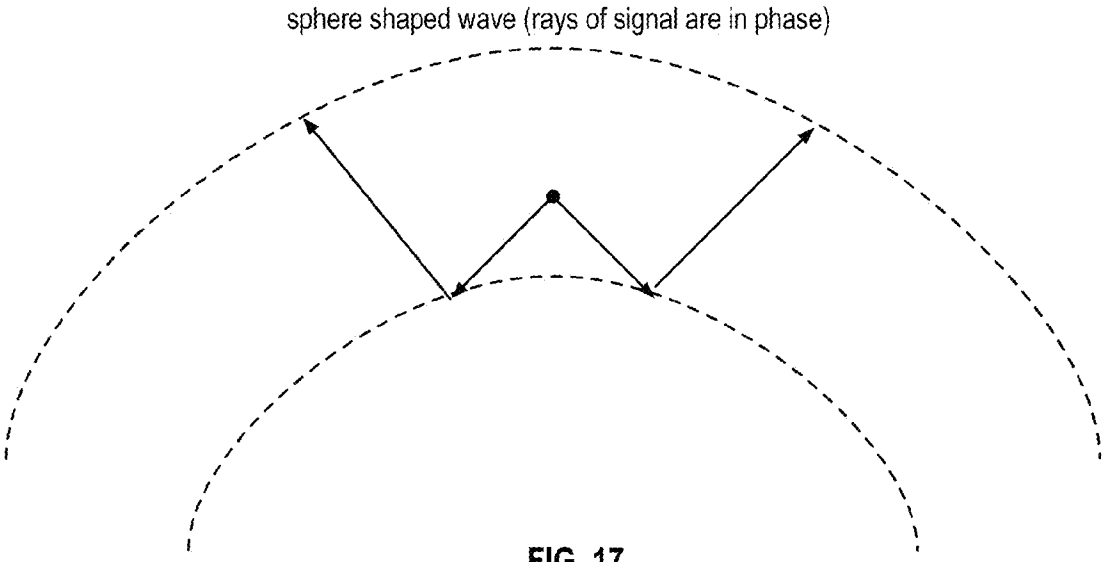
FIG. 17 is a diagram of another example of a plane wave resulting from a parabolic shaped projected artificial magnetic conductor (AMC) in accordance with the present invention.

FIG. 17 is a diagram of another example of a projected artificial magnetic minor (PAMM) 26 generating a projected artificial magnetic conductor (AMC) 60 having a sphere-based shape (e.g., a sphere, a partial sphere, a cylinder, a partial cylinder, etc.). For a given electromagnetic signal, the parabolic AMC 60 causes an arced plane wave to occur at some distance from the AMC 60. Such an AMC 60 may be useful for an omnidirectional antenna or surface-to-surface omnidirectional antenna.

Figure 18:
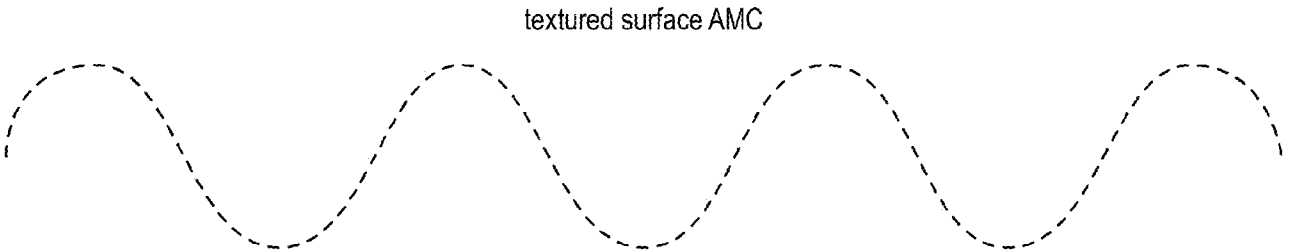
FIG. 18 is a diagram of an example of a textured surface shaped projected artificial magnetic conductor (AMC) in accordance with the present invention.

FIG. 18 is a diagram of an example of a projected artificial magnetic mirror (PAMM) 26 generating a projected artificial magnetic conductor (AMC) 60 having a textured surface. The textured surface may have one or more peaks and valleys.

Figure 19:
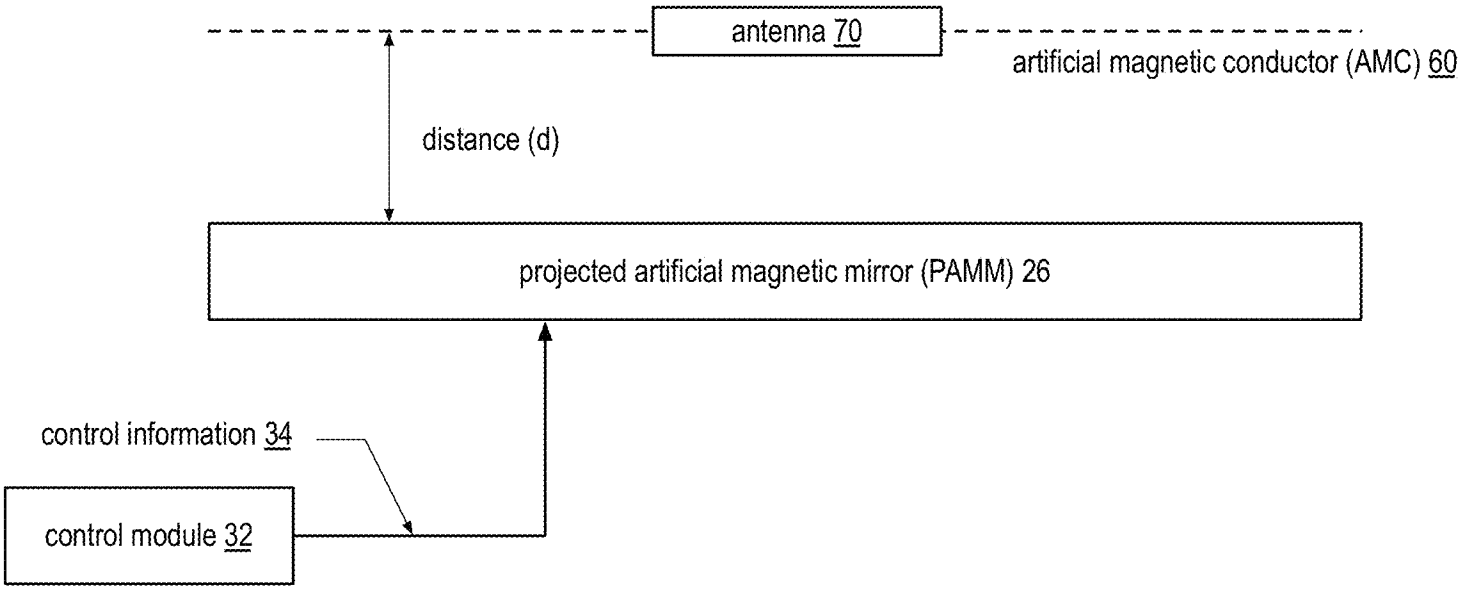
FIG. 19 is a schematic block diagram of another embodiment of an antenna structure in accordance with the present invention.

FIG. 19 is a schematic block diagram of another embodiment of a projected artificial magnetic mirror (PAMM) 26 generating a projected artificial magnetic conductor (AMC) 60 a distance (d) above its surface. The shape of the projected AMC 60 is based on the characteristics of the artificial magnetic mirror (AMM) cells of the PAMM 26, wherein the characteristics are adjustable via the control information 34. In this example, the projected AMC 60 is a plane. Alternatively, the shape of the AMC could be a sphere, a partial sphere, a cylinder, a partial cylinder, a plane, a textured surface, a concaved surface, or a convex surface.

In this example, an antenna 70 (e.g., dipole, monopole, helical, etc.) is positioned at a desired location with respect to the AMC 60. If the AMC 60 has a geometric shape of a plane, then the desired location of the antenna 70 may be in line with the plane. If the AMC 60 has a parabolic geometric shape, then the desired location of the antenna 70 may be at a focal point of the parabolic shape. If the AMC 60 has a spherical-based geometric shape, then the desired location of the antenna 70 may be at a point from a surface of the spherical-based shape.

Figure 20:
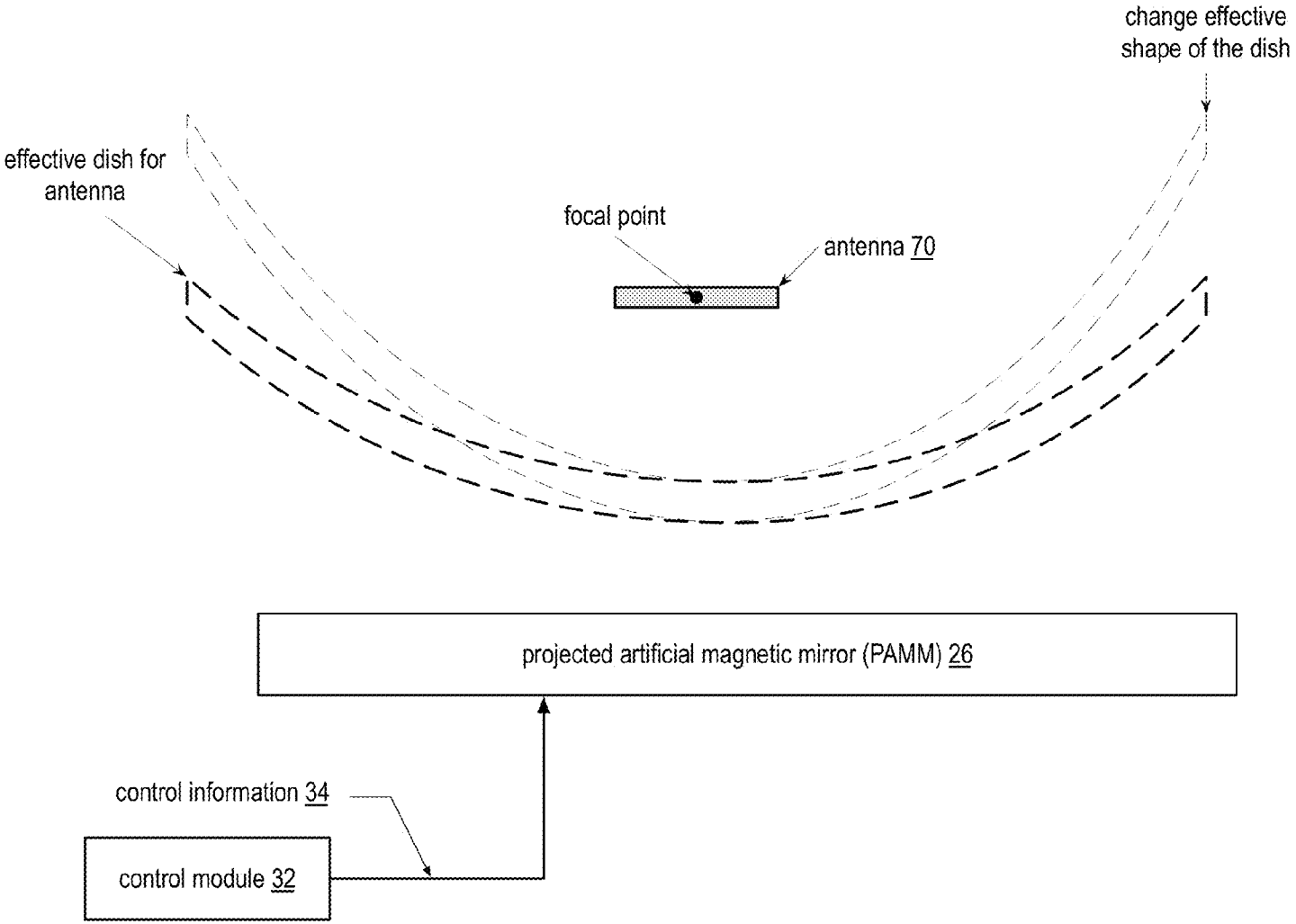
FIG. 20 is a schematic block diagram of an embodiment of a tunable antenna structure in accordance with the present invention.

FIG. 20 is a schematic block diagram of an embodiment of a tunable antenna structure that includes a projected artificial magnetic mirror (PAMM) 26, an antenna 70, and a control module 32. In this example, the PAMM 26 is generating an initial projected artificial magnetic conductor (AMC) 60 having a parabolic shape of $y=ax^2$. The control module 32 generates the control information 34 to tune the "a" term of the parabolic shape, thereby changing the parabolic shape of the AMC 60.

The parabolic shaped AMC 60 provides an effective dish for the antenna 70. In this example, the antenna 70 is positioned at a focal point of the parabolic shaped AMC 60. In this manner, a dish antenna is achieved using essentially flat circuitry.

Figure 21:
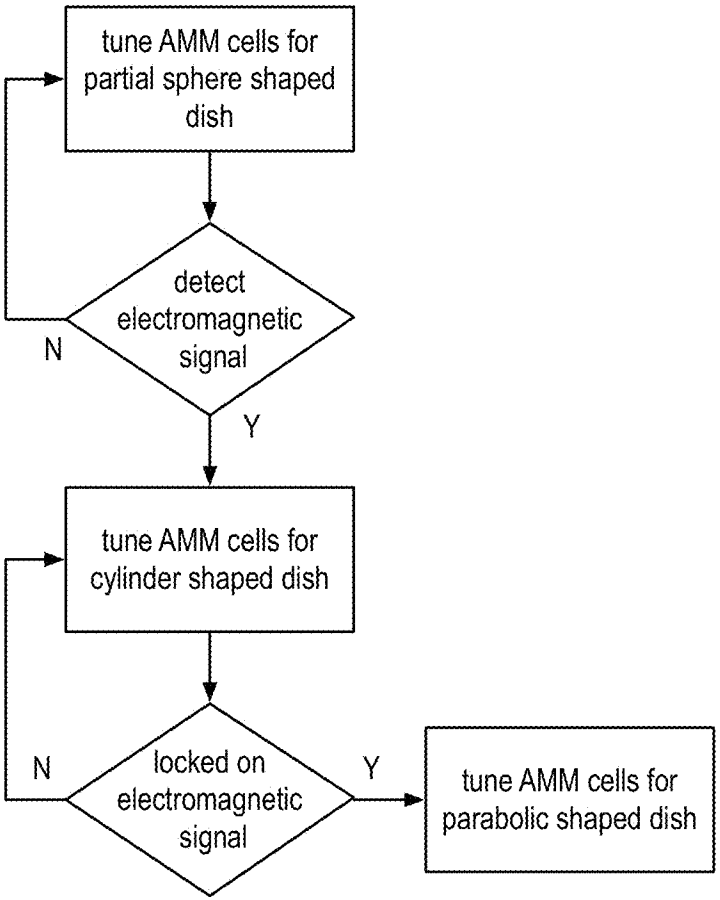
FIG. 21 is a logic diagram of an embodiment of a method for tuning an antenna structure in accordance with the present invention.

FIG. 21 is a logic diagram of an embodiment of a method for tuning an antenna structure that begins with the control module 32 providing control information 34 to one or more of the AMM cells of the PAMM 26, such that the PAMM 26 produces a projected AMC 60 having a partial sphere shaped dish (e.g., as shown in FIG. 17). With an antenna positioned a desired location with respect to the partial sphere shaped AMC 60, the antenna structure is an omnidirectional antenna. In this manner, signals from any direction will be received with approximately the same signal strength (assuming the same transmit power and the transmitting sources (or radar reflecting sources) are about the same distance from the antenna).

The method continues by determining whether an electromagnetic signal is detected, where the electromagnetic signal may be a wireless communication device transmission or a reflected radar signal. If a signal is not detected, the method waits until one is detected. Once a signal is detected, the method continues with the control module generating control information to tune one or more AMM cells of the PAMM to produce a cylinder shaped AMC. In this instance, a cylinder shaped dish antenna is achieved, which functions well for radar systems to track motion of an object.

The method continues by determining whether the system has locked on to the electromagnetic signal (e.g., easily tracking it or it is relatively stationary). If not, the method repeats as shown. If yes, the method continues with the control module generating control information to tune one or more AMM cells of the PAMM to produce a parabolic shaped AMC. In this instance, a parabolic shaped dish antenna is achieved, which functions well for satellite communications, point-to-point microwave links, etc.

Figure 22:
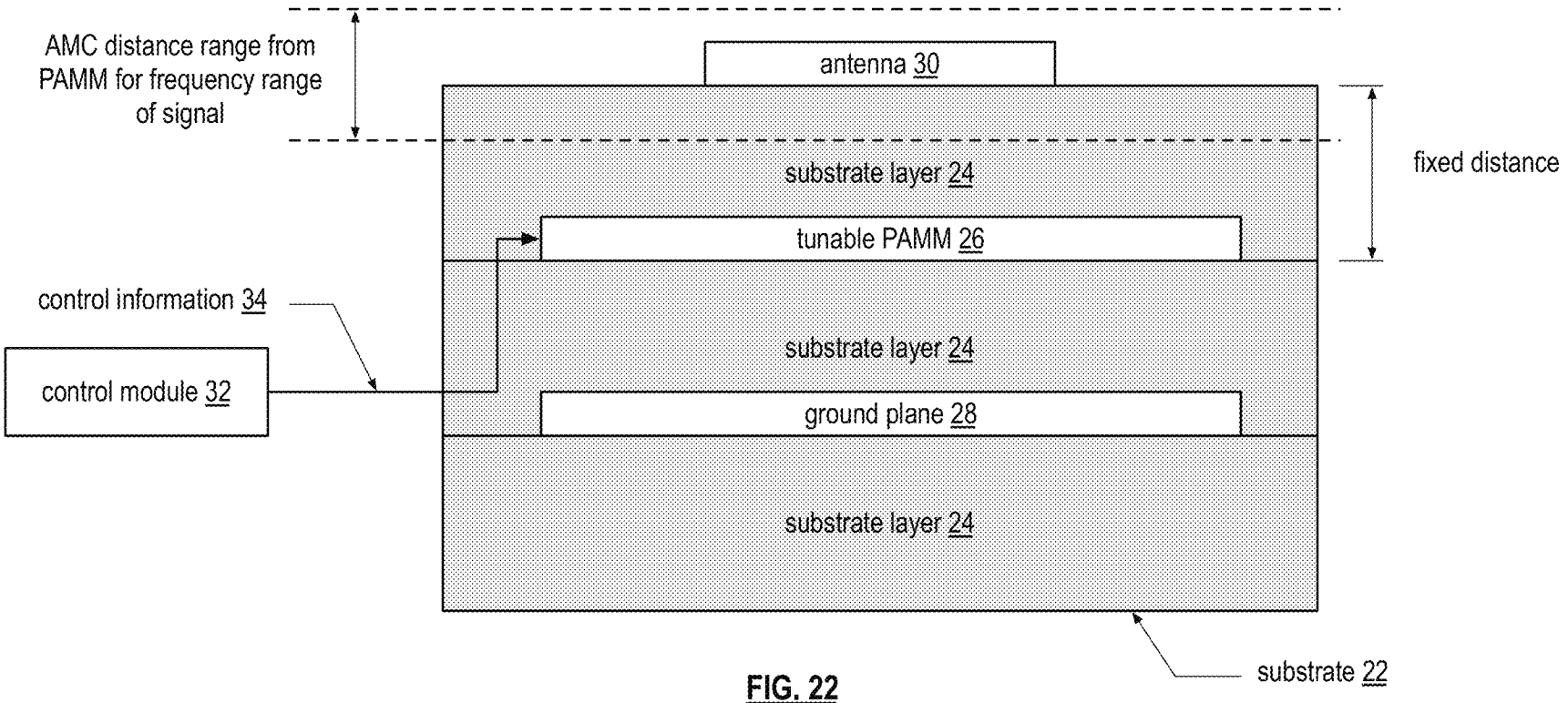
FIG. 22 is a schematic block diagram of an example of tuning a distance of an AMC for an antenna structure in accordance with the present invention.

FIG. 22 is a schematic block diagram of an example of an antenna structure 20 that may be implemented on a substrate. The antenna structure 20 includes an antenna 30 (e.g., a monopole, a dipole, helical, etc.) on one layer 24 of the substrate 22, a tunable projected artificial magnetic mirror (PAMM) 26 on another layer 24, a ground plane 28 on another layer 24, and a control module 32. The tunable PAMM 26 includes a plurality of artificial magnetic mirror (AMM) cells.

In an example of operation, the control module 32 generates control information 34 and provides it to one or more of the AMM cells of the PAMM 26. The control information 34 includes one or more control signals for tuning an electromagnetic property, or properties, (e.g., radiation pattern, polarization, gain, scatter signal phase, scatter signal magnitude, gain, etc.) of one or more of the AMM cells within a given frequency band for an electromagnetic signal. For example, the electromagnetic signal may be a radar signal in a 2 GHz frequency band, in a 60 GHz frequency band, etc. As another example, the electromagnetic signal may be a communication signal in a 900 MHz frequency band, a 1.8 MHz frequency band, a 2 GHz frequency band, a 2.4 GHz frequency band, 5 GHz frequency band, a 29 GHz frequency band, a 60 GHz frequency band, or some other frequency band.

The tuning of one or more of the AMM cells tunes the distance of the artificial magnetic conductor (AMC) from the surface of the tunable PAMM for the electromagnetic signal. In general, at different frequencies, the AMC will have different distances from the surface of the PAMM 26. Accordingly, by tuning one or more AMM cells of the PAMM, the distance of the AMC can be adjusted to a desired distance (e.g., the thickness of the corresponding substrate layer, or layers).

Figure 23:
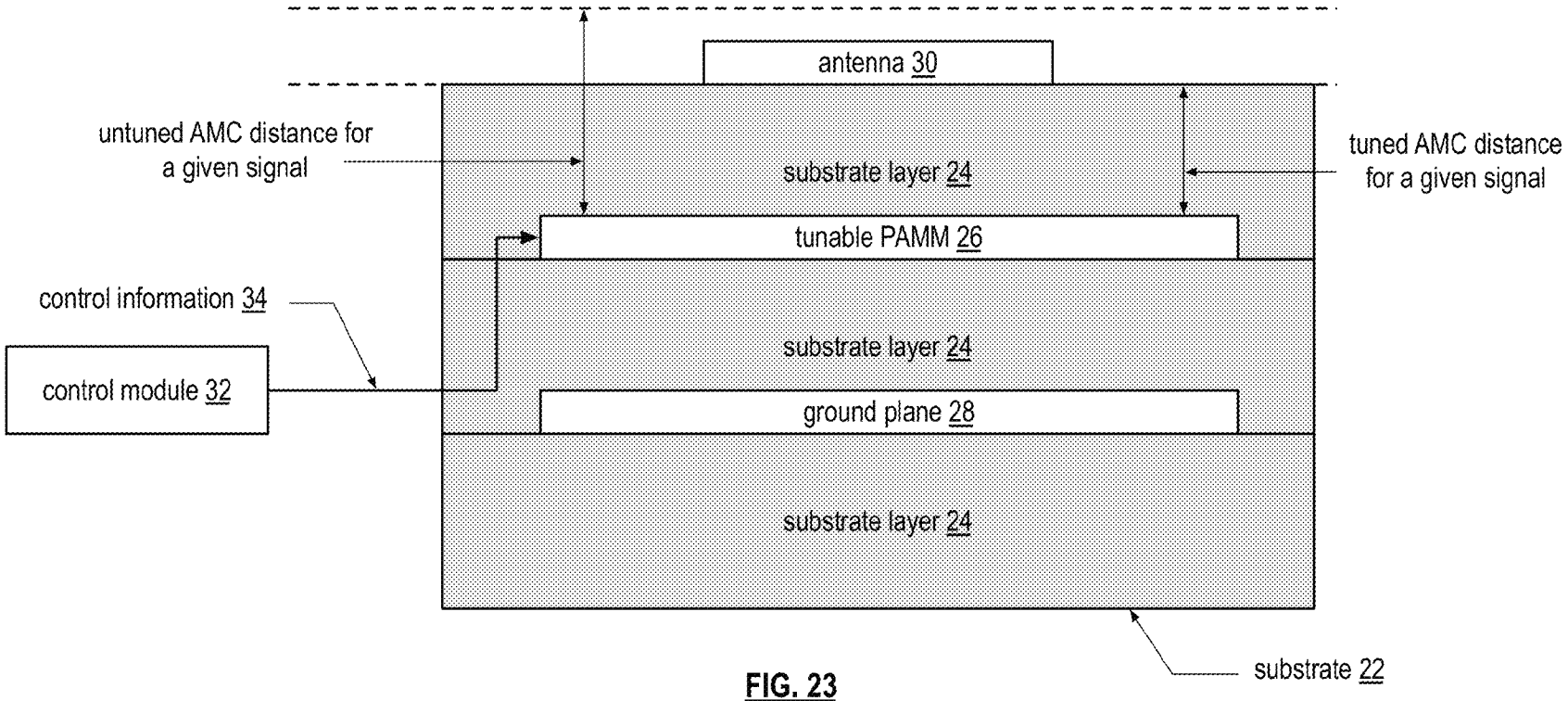
FIG. 23 is a schematic block diagram of another example of tuning a distance of an AMC for an antenna structure in accordance with the present invention.

FIG. 23 is a schematic block diagram of another example of tuning a distance of an AMC for an antenna structure that is a continuation of FIG. 22. In this diagram, an unturned distance for a given electromagnetic signal is a distance above the layer on which the antenna 30 lies. Knowing, or determining, the frequency of the signal, the control module 32 can generate control information 34 to adjust the distance of the AMC to a desired distance (e.g., at the surface of the layer on which the antenna 30 lies).

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While the transistors in the above described figure(s) is/are shown as field effect transistors (FETs), as one of ordinary skill in the art will appreciate, the transistors may be implemented using any type of transistor structure including, but not limited to, bipolar, metal oxide semiconductor field effect transistors (MOSFET), N-well transistors, P-well transistors, enhancement mode, depletion mode, and zero voltage threshold (VT) transistors.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A tunable projected artificial magnetic mirror (PAMM) comprises:

a plurality of artificial magnetic mirror (AMM) cells that collectively produce an artificial magnetic conductor (AMC) comprising an electromagnetic reflective surface with an electromagnetic state in which a tangential magnetic field is zero and in a non-planar geometric shape located at a distance above a surface of the tunable PAMM for an electromagnetic signal in a given frequency range; and a control module operably coupled to the plurality of AMM cells, wherein the control module provides control information to one or more of the plurality of AMM cells to tune at least one of the geometric shape of the AMC and the distance of the AMC from the surface of the tunable PAMM.

2. The tunable PAMM of claim 1, wherein an AMM cell of the plurality of AMM cells comprises:

a conductive element forming a lumped resistor-inductor-capacitor (RLC) circuit; and a variable impedance circuit coupled to the conductive element, wherein an impedance of the impedance element and an impedance of the RLC circuit establish an electromagnetic property for the AMM cell within the given frequency range that contributes to the AMC.

3. The tunable PAMM of claim 1 further comprises:

the geometric shape of the AMC including a parabolic shape of $y=ax^2$; and the control module generating the control information to tune the "a" term of the parabolic shape.

4. The tunable PAMM of claim 1, wherein the geometric shape of the AMC comprises one of:

a sphere;

a partial sphere;

a cylinder; or a partial cylinder.

5. The tunable PAMM of claim 1, wherein the geometric shape of the AMC comprises one of:

a textured surface;

a concaved surface; or a convex surface.

6. The tunable PAMM of claim 1 further comprises:

the control module generating the control information to tune orientation of the geometric shape of the AMC with respect to the surface of the tunable PAMM.

7. A tunable virtual dish antenna comprises:

a plurality of artificial magnetic mirror (AMM) cells on a first layer of a substrate, wherein the plurality of AMM cells collectively produce an artificial magnetic conductor (AMC) comprising an electromagnetic reflective surface with an electromagnetic state in which a tangential magnetic field is zero and in a dish shape located above the first layer for an electromagnetic signal in a given frequency range;

a control module operably coupled to the plurality of AMM cells, wherein the control module provides control information to one or more of the plurality of AMM cells to tune the dish shape of the AMC; and an antenna on a second layer of the substrate positioned in a desired location with respect to the AMC, wherein the antenna transmits or receives the electromagnetic signal.

8. The tunable virtual dish antenna of claim 7, wherein an AMM cell of the plurality of AMM cells comprises:

a conductive element forming a lumped resistor-inductor-capacitor (RLC) circuit; and a variable impedance circuit coupled to the conductive element, wherein an impedance of the impedance element and an impedance of the RLC circuit establish an electromagnetic property for the AMM cell within the given frequency range that contributes to the AMC.

9. The tunable virtual dish antenna of claim 7 further comprises:

the control module generating the control information to tune the plurality of AMM cell such that a plane wave is formed with respect to the dish shape at which rays of the electromagnetic signal are substantially in phase.

10. The tunable virtual dish antenna of claim 9 further comprises:

the control module generating the control information to tune the plurality of AMM cell such that orientation of the plane wave with respect to the dish shape is changed to effectuate signal scanning.

11. The tunable virtual dish antenna of claim 7, wherein the dish shape comprises:

a partial sphere such that the tunable virtual dish antenna provides a surface to surface omnidirectional antenna.

12. The tunable virtual dish antenna of claim 7, wherein the dish shape comprises:

a partial cylinder such that the tunable virtual dish antenna provides a scanning antenna.

13. The tunable virtual dish antenna of claim 7, wherein the dish shape comprises:

a parabolic shape such that the tunable virtual dish antenna provides a directional antenna.

14. The tunable virtual dish antenna of claim 7 further comprises:

the control module generating the control information to:

tune the plurality of AMM cell to produce a partial sphere shaped dish to detect presence of the electromagnetic signal;

when the presence of the electromagnetic signal is detected, tune the plurality of AMM cell to produce a partial cylinder shaped dish to track the electromagnetic signal; and when locked on to the electromagnetic signal, tune the plurality of AMM cell to produce a parabolic shaped dish.

15. A tunable antenna comprises:

a plurality of artificial magnetic mirror (AMM) cells on a first layer of a substrate, wherein the plurality of AMM cells collectively produce an artificial magnetic conductor (AMC) comprising an electromagnetic reflective surface with an electromagnetic state in which a tangential magnetic field is zero and in a non-planar geometric shape with respect to the first layer for an electromagnetic signal in a given frequency range;

an antenna on a second layer of the substrate wherein the antenna transmits or receives the electromagnetic signal; and a control module operably coupled to the plurality of AMM cells, wherein the control module provides control information to one or more of the plurality of AMM cells to tune a distance of the AMC from the first layer such that the antenna is at desired position with respect to the AMC.

16. The tunable antenna of claim 15, wherein an AMM cell of the plurality of AMM cells comprises:

a conductive element forming a lumped resistor-inductor-capacitor (RLC) circuit; and a variable impedance circuit coupled to the conductive element, wherein an impedance of the impedance element and an impedance of the RLC circuit establish an electromagnetic property for the AMM cell within the given frequency range that contributes to the AMC.

17. The tunable antenna of claim 15 further comprises:

the geometric shape of the AMC including a parabolic shape of $y=ax^2$; and the control module further generating the control information to tune the "a" term of the parabolic shape.

18. The tunable antenna of claim 15, wherein the geometric shape of the AMC comprises one of:

a sphere;

a partial sphere;

a cylinder; or a partial cylinder.

19. The tunable antenna of claim 15, wherein the geometric shape of the AMC comprises one of:

a textured surface;

a concaved surface; or a convex surface.

20. The tunable antenna of claim 15 further comprises:

the control module further generating the control information to tune orientation of the geometric shape of the AMC with respect to the surface of the tunable antenna.

* * * * *